US005088949A

United States Patent [19]

Atkinson et al.

[11] Patent Number: 5,088,949

[45] Date of Patent: Feb. 18, 1992

[54] OSCILLATION-DRIVEN VEHICLE

[76] Inventors: Virgil Atkinson, 605 S. Derrick St.; William G. Owens, Jr.; William G. Owens, III, both of Box 325, all of Dahlonega, Ga. 30533

[21] Appl. No.: 639,875

[22] Filed: Jan. 11, 1991

[51] Int. Cl.[5] ..... A63H 11/02; A63H 1/00; A63H 17/00; A63H 33/00

[52] U.S. Cl. ..... 446/3; 446/236; 446/437; 446/489

[58] Field of Search ..... 446/3, 153, 154, 160, 446/163, 233, 236, 238, 237, 230, 231, 232; 431/437, 444, 484, 485, 486, 489, 491

[56] References Cited

U.S. PATENT DOCUMENTS

| | | | |
|---|---|---|---|
| 2,179,084 | 11/1939 | Cook | 446/3 X |
| 2,618,888 | 11/1952 | Hoff | 446/484 X |
| 2,919,921 | 1/1960 | Berger | 446/3 X |
| 3,196,580 | 7/1965 | Rakestraw | 446/3 X |
| 3,425,689 | 2/1969 | Convertine | 272/27 R |
| 3,530,617 | 9/1970 | Halvorson et al. | 446/3 X |
| 3,696,557 | 10/1972 | Ruppel | 446/444 |
| 3,772,824 | 11/1973 | Terzian et al. | 446/429 |
| 3,842,532 | 10/1974 | Nielsen | 446/470 |
| 4,219,957 | 9/1980 | Kakuta | 446/230 |
| 4,449,323 | 5/1984 | Fisher | 446/437 |
| 4,702,720 | 10/1987 | Konta et al. | 446/448 |
| 4,927,401 | 5/1990 | Sonesson | 446/437 X |

FOREIGN PATENT DOCUMENTS

| | | | |
|---|---|---|---|
| 1145460 | 10/1957 | France | 446/3 |
| 2358174 | 3/1978 | France | 446/3 |
| 1505562 | 9/1989 | U.S.S.R. | 446/163 |
| 11023 | of 1914 | United Kingdom | 446/3 |

*Primary Examiner*—David N. Muir

*Attorney, Agent, or Firm*—Shlesinger, Arkwright & Garvey

[57] ABSTRACT

A vehicle comprises a rigid longitudinal body having a bottom surface engaging the ground and having spaced first and second ends along a longitudinal axis. The bottom surface includes a convex cross-section along its longitudinal axis. The vehicle includes an oscillation generator having horizontal and vertical force components is mounted adjacent and secured to one of the first and second ends for generating vibratory motions, thereby imparting vibrations to the body. The vibratory motions generated by the oscillation generator alternately lift and propel the vehicle forward.

22 Claims, 3 Drawing Sheets

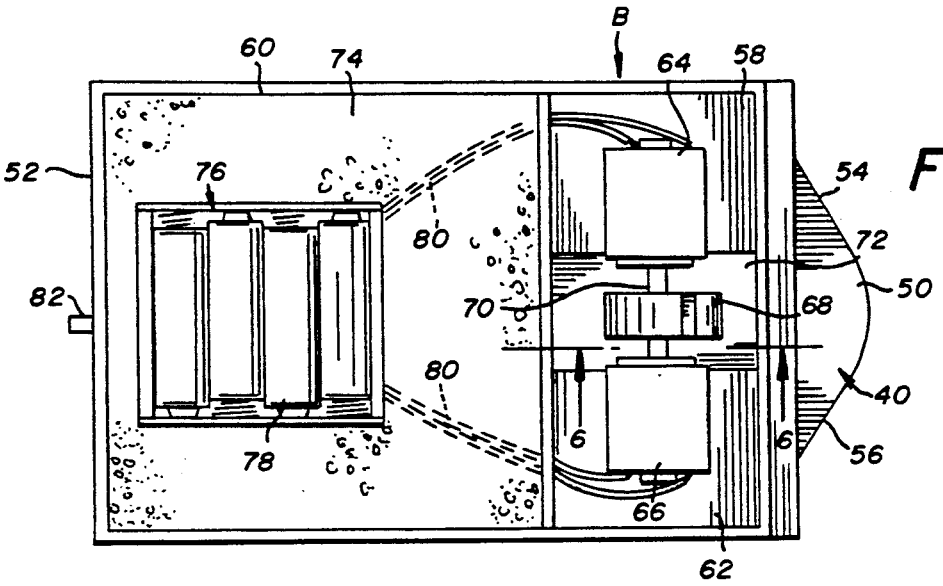
FIG. 4
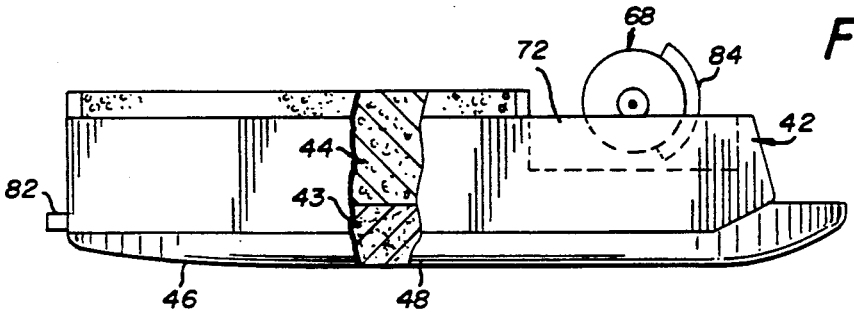
FIG. 5
FIG. 6
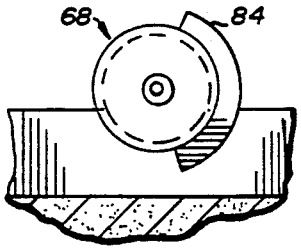
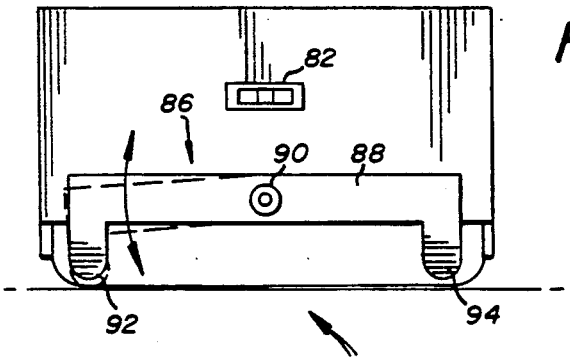
FIG. 7
FIG. 8
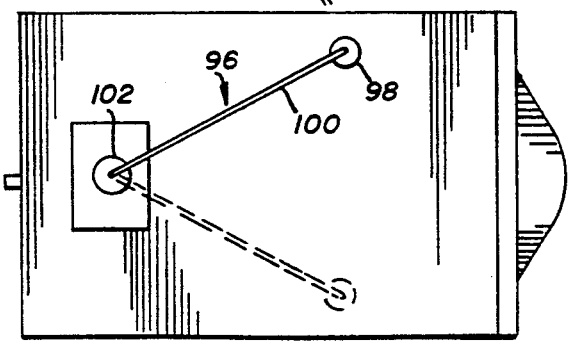
FIG. 9
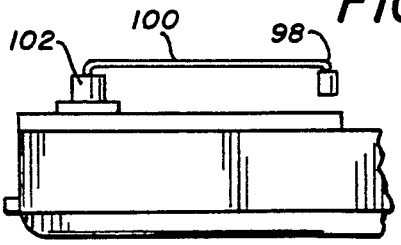

Fig. 13
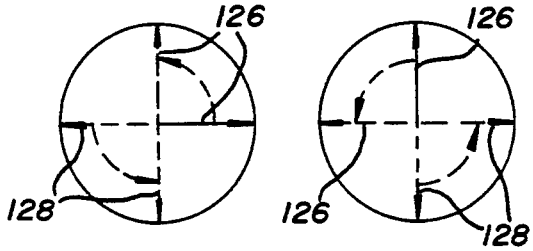
Fig. 12
Fig. 15
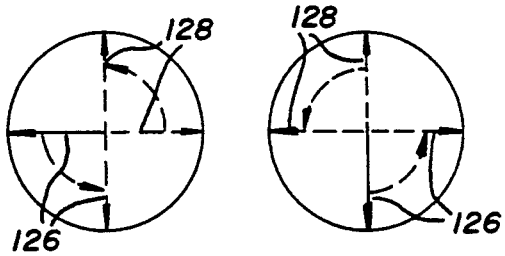
Fig. 14
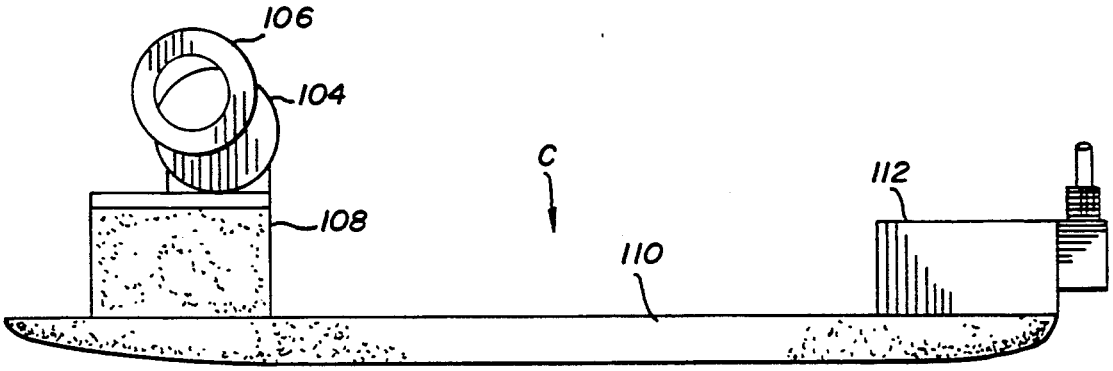
Fig. 10
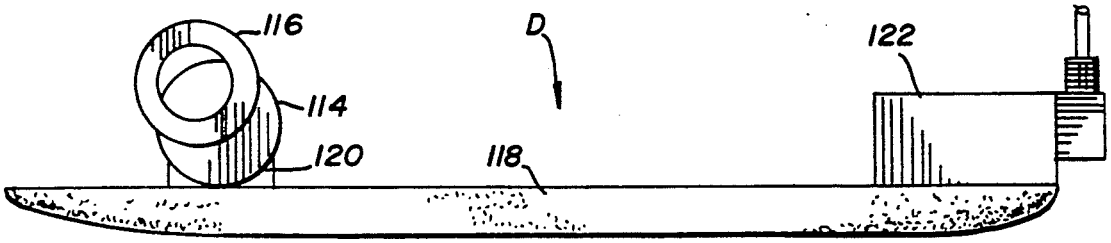
Fig. 11

OSCILLATION-DRIVEN VEHICLE

FIELD OF THE INVENTION

The present invention relates generally to a vehicle and in particular to a toy vehicle propelled by internally generated oscillations.

BACKGROUND OF THE INVENTION

In a conventional toy vehicle, motor-driven wheels are typically secured to a body of the toy vehicle to move the vehicle along. For relatively smooth surfaces, the wheels are typically adequate. However, in rough terrain, the wheels may have to be replaced with tracks or provided with all-wheel drive capability to provide adequate motive power to the vehicle.

For water-borne toy vehicles, it is typical to provide the vehicle with a propeller to move the vehicle along the water.

A toy vehicle, once designed for one type of surface typically will not operate adequately on a different type of surface. For example, a toy vehicle designed for travelling on a smooth surface, will probably encounter difficulty in operating on a rough surface such as gravel road, sand, etc. Also, a toy vehicle designed to operate on the ground generally will not be operable in water.

The present invention is therefore designed for a toy vehicle with a drive means that can operate on any type of surface, including smooth surface, rough surface, water, etc.

OBJECTS AND SUMMARY OF THE INVENTION

It is therefore an object of the present invention to provide a vehicle with a drive means that will operate on any type of surface, such as paved surface, gravel surface, water, etc.

It is another object of the present invention to provide a vehicle that is propelled without any visible external motive means.

I is still another object of the present invention to provide a vehicle that is propelled by internally generated vibrations.

In summary, the present invention provides a vehicle that can move on the ground and on the water with a single drive means.

These and other objects of the present invention will become apparent from the following detailed description.

BRIEF DESCRIPTIONS OF THE DRAWINGS

FIG. 4 is a top plan view of an alternative embodiment of a toy vehicle according to the present invention.

FIG. 5 is a side elevational view, with portions shown in cross-section, of the toy vehicle shown in FIG. 4.

FIG. 6 is a fragmentary, enlarged cross-sectional view taken along line 6—6 of the toy vehicle shown in FIG. 4.

FIG. 7 is a rear elevational view of the toy vehicle shown in FIG. 4, showing a type of steering mechanism used in the present invention.

FIG. 8 is a top plan view of a toy vehicle in accordance with the present invention showing another type of steering mechanism.

FIG. 9 is a fragmentary, side elevational view of the toy vehicle shown in FIG. 8.

FIG. 10 is a schematic side elevational view of another alternative embodiment of a toy vehicle according to the present invention.

FIG. 11 is a schematic side elevational view of another alternative embodiment of a toy vehicle according to the present invention.

FIGS. 12–15 show schematic force diagrams generated by an oscillation generator used in the present invention.

DETAILED DESCRIPTION OF THE INVENTION

Figure 1:
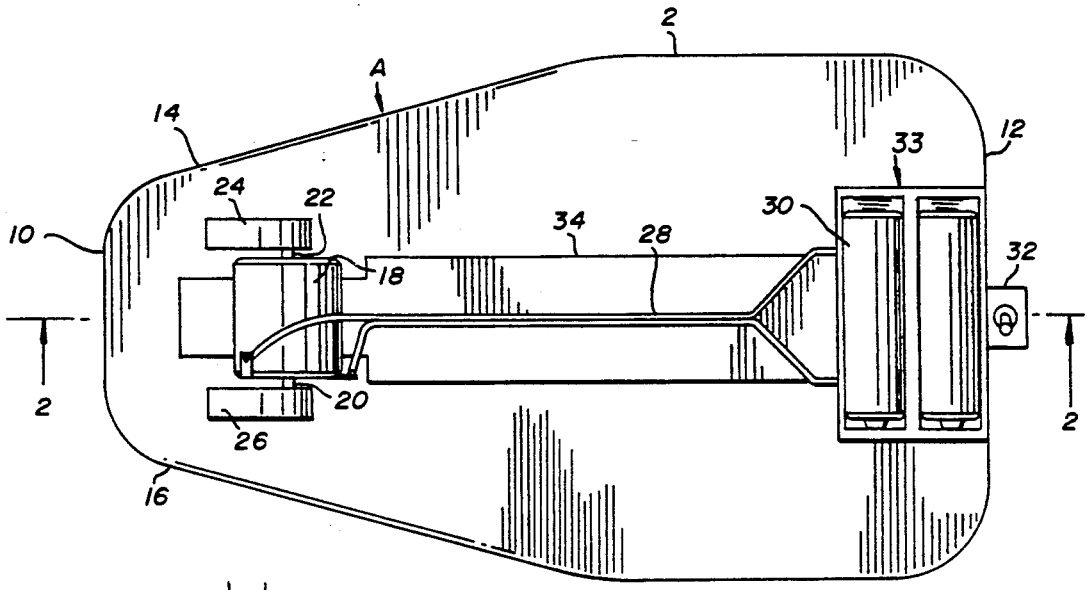
FIG. 1 is a top view plan of an embodiment of a toy vehicle according to the present invention.
Figure 3:
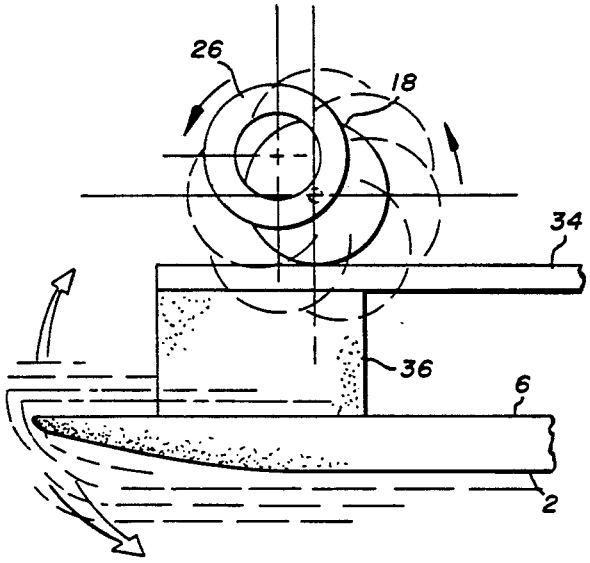
FIG. 3 is a fragmentary, enlarged side elevational view of a front end portion of the toy vehicle of FIG. 1.
Figure 2:
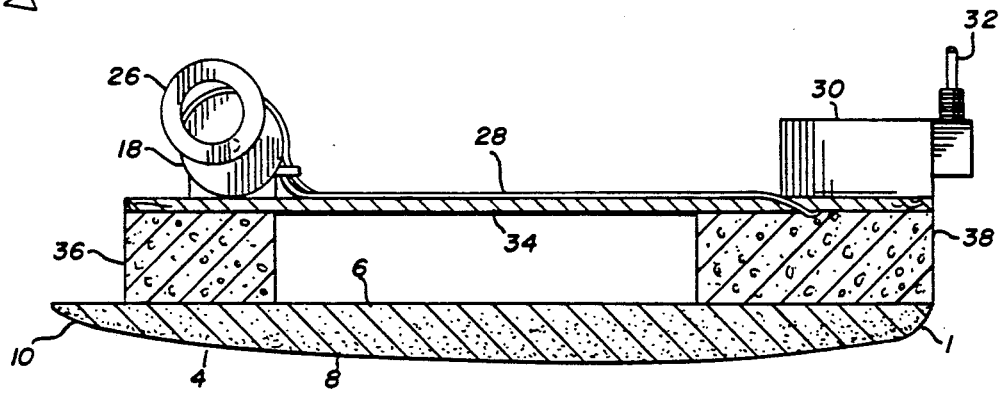
FIG. 2 is a cross-sectional view taken along line 2—2 of the toy vehicle of FIG. 1.

An illustrative embodiment of a toy vehicle A is disclosed in FIG. 1. The toy vehicle A comprises a rigid body 2 made of lightweight material, such as styrofoam. The body 2 has a lower surface 4 that engages the ground and an upper surface 6, as best shown in FIG. 2. The lower surface 4 is slightly convex, with the low point 8 of the curve located near the center of gravity of the toy vehicle A, as best shown in FIG. 2.

The convex lower surface 4 is essential for relatively superior performance of the vehicle A. The convex shape provides localized contact point between the body 2 and the ground that is nearly kept near the center of gravity during operation. This localized, stable contact point greatly reduces the effect of external torques and allows the vehicle A to traverse rough terrain, as well as smooth surfaces.

The body 2 is substantially rectangular with a longitudinal axis and a front end 10 spaced from a rear end 12. Side tapers 14 and 16 advantageously provide for relatively superior obstacle navigation, as best shown in FIG. 1. The rectangular shape advantageously provides relatively superior directional stability.

Means for generating vibratory motions for the toy vehicle A comprise an electric motor 18 having output shaft end portions 20 and 22 that are operably secured to eccentric flywheels 24 and 26, respectively. A set of wires 28 operably connects the motor 18 to a set of batteries 30 disposed adjacent the rear end of the body 2 A switch 32 provides an on/off operation to the motor 18. Although the batteries 30 provide a weight means 33 for counterbalancing the weight of the motor 18 and the flywheels 24 and 26, the weight means 33 is not necessary for the operation of the vehicle A. A remote power source (not shown), not carried by the vehicle A, will advantageously not burden the vehicle A and make it operate more efficiently. A person of ordinary skill in the art will understand that other sources of power, such as solar powered cells (not shown), may also be used instead of the batteries 30.

A rigid member 34, such as a wooden support, provides a rigid structural connection between the motor 18 and the batteries 30, as best shown in FIG. 2.

The flywheels 24 and 26 are ring-shaped and are mounted off center to the respective shaft end portions 20 and 22. A person of ordinary skill in the art will understand that any type and shape of flywheel, such as a rod (not shown) connected transversely to the shaft, will work.

The motor 18 and weight means 33 are rigidly secured to the opposite ends of the rigid member 34 by standard means, such as adhesives, etc. A foam rubber block 36 is operably secured adjacent to the front end 10 of the body 2 and directly underneath the motor 18. A foam rubber block 38 is likewise operably secured adjacent the rear end 12 of the body 2 and directly underneath the weight means 33, as best shown in FIG. 2.

The motor 18, weight means 33 and the rigid member 34 collectively act as a rigid body that oscillates relative to the rigid body 2.

A lightweight shell or encasement (not shown) may be added to the toy vehicle A to provide a pleasing appearance to it. The vehicle A may also include any devices (not shown) to permit remote control actions, including start/stop, speed, forward/reverse, steering, etc.

A toy vehicle B is disclosed in FIGS. 4 and 5 as an alternative embodiment of the present invention. The toy vehicle B includes a rigid body 40 made of light weight material, such as styrofoam. A housing 42 made of light weight material, such as balsa wood, is operably secured to a side portion 43 of the body 40, as best shown in FIG. 5. The body 40 has a lower surface 46 that engages the ground or water surface and has a slightly convex cross-sectional shape similar to the lower surface 4 of the toy vehicle A, as best shown in FIG. 5. The lower surface 46 has a low point 48 that substantially corresponds with the center of gravity of the toy vehicle B. The body 40 has a front end 50 and a rear end 52. The front end 50 has tapers 54 and 56 for obstacle navigation.

The housing 42 has a forward compartment 58 and a rear compartment 60. The forward compartment 58 has a spacer block 62, preferably made of the same material as the body 40, such as styrofoam, that is rigidly connected to the underlying portion of the body 40. Electric motors 64 and 66 are rigidly secured to the top surface of the spacer block 62 by adhesives (not shown) or by any conventional means such that oscillations generated by the motors 64 and 66 are effectively transmitted to the body 40. A common shaft 70 connects the motors 64 and 66. An eccentric flywheel 68 is operably secured to the shaft 70 intermediate the motors 64 and 68. A recess 72 in the spacer block 62 provides clearance for the rotation of the flywheel 68, as best shown in FIG. 5.

The rear compartment 60 has a foam rubber block 74 that supports a weight means 76, which, in this case, is a set of batteries 78 that are operably connected to the motors 64 and 66 by a set of wires 80. A switch 82 provides on/off control to the motors 64 and 66.

The eccentric flywheel 68 has a weight 84 secured to a portion of its circumferential edge. The weight 84 generates oscillations during rotation of the flywheel 68 during rotation by the motors 64 and 66 that is imparted to the body 40 that causes it to move.

In the embodiment of the vehicle B, the motors 64 and 66 and the body 40 act as a rigid body that oscillates relative to the weight means 76.

Steering capability to the toy vehicles A and B may be provided by steering mechanism 86, as best shown in FIG. 7. The steering mechanism 86 comprises a U-shaped member 88 pivotable at pivot 90 and has ground engaging portions 92 and 94. A person of ordinary skill in the art will understand that when the portion 92 engages the ground, the vehicle will tend to move towards the left. In the same fashion, when the portion 94 engages the ground, the vehicle would tend to move to the right. The U-shaped member 90 may be pivoted by remote control (not shown).

Another steering mechanism 96 may be used with the toy vehicles A and B, as disclosed in FIG. 8. The steering mechanism 96 involves shifting a weight 98 such that the center of gravity of the vehicle is shifted. The steering mechanism 96 has an arm 100 pivotable at end portion 102 and carries the weight 98 at the other end of the arm. When the weight 98 is disposed towards the left, the vehicle would tend to move to the left. When the weight 98 is moved to the right, the vehicle would tend to move to the right. A remote control operator (not shown) may be activated by radio control to move the arm 100 either to the left or to the right of the vehicle.

Another way of steering the vehicles A and B is to provide means (not shown) for rotating the motors 18 and 64 and 66 about their horizontal and/or vertical axes. A person of ordinary skill in the art will understand that there are other steering mechanisms in addition to those described above.

Another alternative embodiment of the present invention is schematically disclosed in FIG. 10 as toy vehicle C, where a motor 104 with an eccentric flywheel 106 is secured to and supported by foam rubber block 108 that is secured to a body 110. A weight means 112, such as a set of batteries for the motor 104, is directly rigidly secured to the body 110. The body 110 is similar is in shape to the body 2 of the vehicle A or the body 40 of the vehicle B. In this embodiment, the motor 104 acts as a rigid body which oscillates relative to the weight means 112 and the body 110.

Still another alternative embodiment of the present invention is disclosed as toy vehicle D, as best shown in FIG. 11. Toy vehicle D has an electric motor 114 with an eccentric flywheel 116. The motor 114 is rigidly secured to a body 118 by means of a rigid mounting block 120. A weight means 122, such as a set of batteries for the motor 114, is rigidly secured to the body 118. The body 118 is similar is in shape to the body 2 of the vehicle A or the body 40 of the vehicle B. In this embodiment, the body 118 should be made of a material that has appropriate oscillatory characteristics. If the body 118 is essentially rigid, the motor speed and flywheel weight can be optimized to achieve relatively good performance.

A person of ordinary skill in the art will understand that the steering mechanisms disclosed for vehicles A and B are also applicable to the vehicles C and D.

OPERATION

The operation of the invention will now be described with reference to the vehicle A. A person of ordinary skill in the art will understand that the description of the operation will equally apply to the other embodiments of the invention. The rotating eccentric flywheels 24 and 26 provide a variable force to the bottom surface 4 of the toy vehicle A that is in contact with an external surface, such as the ground.

The rotation of the eccentric flywheels 24 and 26 creates centrifugal forces 126 directed outwardly from the shaft end portions 20 and 22 through the axis of the imbalance weight that in turn generates centripetal reaction forces 128 directed opposite to the centrifugal forces. The centripetal forces 128 will have horizontal and vertical components that help to move the vehicle A along its path. The forces generated by the flywheels 24 and 26 will be traced through each quadrant, starting at the first quadrant at the 3 o'clock position, as best shown in FIGS. 12–15.

As the centrifugal force 126 generated by the imbalance in the flywheels 24 and 26 rotates counter-clockwise from the 3 o'clock position to the 12 o'clock position, centripetal forces 128 will be generated in the opposite quadrant, which is bounded by the 6 and 9 o'clock positions, as best shown in FIG. 12. These centripetal forces 128 are directed toward the front end 10 of the body 2 and toward the ground. The vertical downward component of the centripetal forces will compress the foam rubber block 36 to store energy and will rotate the body 2 toward the ground about the low point 8 on the lower surface 4. The forward horizontal component of the centripetal forces will not move the vehicle forward, since the friction forces between the lower surface 4 that is in contact with the ground ahead of the pivot 8 will be greater.

As the centrifugal force 126 rotates from the 12 o'clock position to the 9 o'clock position, centripetal forces 128 will be generated in the fourth quadrant bounded by the 3 and 6 o'clock positions, as best shown in FIG. 13. These centripetal forces will be directed downwardly toward the ground and rearwardly toward the rear end 12. The vertical downward component of the centripetal forces will continue to compress the foam rubber block 36. The horizontal rearward component of the centripetal forces will not move the vehicle A rearwardly because of greater friction forces between the lower surface 4 that is in contact with the ground ahead of the pivot point 8 and the ground.

As the centrifugal force 126 generated by the flywheels 24 and 26 move from the 9 o'clock position to the 6 o'clock position, centripetal forces 128 will be generated in the first quadrant bounded by the 12 and 3 o'clock positions, as best shown in FIG. 14. These centripetal forces will be directed upwardly and rearwardly, causing the foam rubber block 36 to release its stored energy to the body 2, to rotate the body 2 about the point 8 toward the rear, and to lift the front end 10 of the body 2. The weight means 33 helps the centripetal forces 128 in rotating the body 2. No rearward movement is experienced, since the friction forces between the lower surface 4 behind the point 8 and the ground is greater than the rearward horizontal force component of the centripetal forces 128. The vertical upward component of the centripetal forces, combined with the downward force exerted by the weight means 33 at the rear end 12, will lift the front end 10 away from the ground.

As the centrifugal force 126 continues to rotate from the 6 o'clock position to the 3 o'clock position, centripetal forces 128 will be generated in the second quadrant bounded by the 9 and 12 o'clock positions, as best shown in FIG. 15. These centripetal forces are directed upwardly and forwardly. The vertical upward component of the centripetal forces, combined with the momentum generated by the downward movement of the weight means 33 in the previous quadrant and the release of energy from the foam rubber block 36, will help to lift the body 2 from the ground. When contact between the lower surface 4 and the ground has been reduced to such an extent that the horizontal component of the centripetal forces becomes greater than the friction forces, the vehicle A then moves forward.

The whole process then repeats itself as the flywheels 24 and 26 continue to rotate, thereby propelling the vehicle A forward.

The direction of travel of the vehicle A may be reversed simply by reversing the rotation of the motor 18. This can be accomplished by reversing the connection of the batteries 30 by circuit means (not shown) or by actually reversing the position of the batteries in the battery holder.

Preferably, the motors 24 and 26 are disposed near the front of the vehicle. The placement of the weight means towards the rear minimizes the torque required by the motor action to displace the vehicles' front portion vertically, thus improving the vehicle's ability to climb obstacles in its path.

In the embodiment of the toy vehicle A, the body 2 and the rigid member 34 are essentially two rigid bodies that are isolated relative to each other. Preferably, both rigid bodies should be as close together as possible and as low as possible to minimize rotational torques and maximize horizontal forces.

Unlike a single mode spring or bimodal cantilever, the horizontal and vertical force components created by the rotation of the flywheels 24 and 26 propel the vehicle A throughout the rotation of the flywheels. This results in a smoother and more efficient operation. The foam rubber block 36 also provides a wider tuning range and wider speed range, thereby permitting the vehicle A to traverse a wider range of surfaces.

The above description provides a simple basic explanation of the operation of the invention. A person of ordinary skill in the art will appreciate that there are other underlying forces that are not described above that nevertheless help in the overall operation of the vehicle A. However, the above description provides a basic understanding of the invention and its operation.

The present invention can be applied to a wide range of vehicle shapes, functions, and sizes. The drive mechanism disclosed herein ma be used for propelling virtually any rigid body having an appropriate weight, weight distribution and bottom surface design. The embodiments of the invention disclosed herein have operated successfully over a variety of surfaces, including smooth surfaces, rough terrain, and water. Although the embodiments of the present invention are directed to a toy vehicle, a person of ordinary skill in the art will understand that the present invention is by no means limited to such application.

While this invention has been described as having preferred design, it is understood that the invention is capable of further modification, uses and/or adaptations following in general the principle of the invention and including such departures from the present disclosure as come within known or customary practice in the art to which the invention pertains, and as may be applied to the essential features set forth and fall within the scope of the invention or the limits of the appended claims.

We claim:

1. A vehicle, comprising:

a) a rigid longitudinal body having a bottom surface engaging the ground and having spaced first and second ends along a longitudinal axis;

b) said bottom surface is convex as viewed along a direction substantially transverse to a longitudinal axis of the vehicle and establishing an essentially localized contact area between said body and the ground to thereby permit said body to rotate about said contact area; and c) means mounted adjacent one of said first and second ends and connected to said body for generating vibratory motions having horizontal and vertical force components, thereby vibrating said body and causing said body to rotate about said contact area;

d) whereby the vibratory motions generated by said generating means periodically rotate and propel the vehicle forward.

2. A vehicle as in claim 1, and further comprising:

a) weight means mounted on said body and adjacent the other end of said body.

3. A vehicle as in claim 2, and further comprising:

a) at least a resilient means disposed between said body and one of said generating means and said weight means.

4. A vehicle as in claim 1, wherein:

a) the vehicle has a center of gravity; and b) said contact area is substantially in line with the center of gravity.

5. A vehicle as in claim 2, wherein:

a) said generating means includes a motor having an output shaft; and b) an eccentric flywheel operably associated with said shaft.

6. A vehicle as in claim 5, wherein:

a) said weight means comprises a battery for said motor.

7. A vehicle as in claim 3, wherein:

a) said generating means is disposed on said at least a resilient means.

8. A vehicle as in claim 3, wherein:

a) said weight means is disposed on said at least a resilient means.

9. A vehicle as in claim 1, wherein:

a) said body is made of styrofoam.

10. A vehicle as in claim 1, wherein:

a) said at least a resilient means is made of foam rubber.

11. A vehicle as in claim 2, wherein:

a) said body includes front and rear ends;

b) said generating means is disposed adjacent said front end; and c) said weight means is disposed adjacent said rear end.

12. A vehicle as in claim 2, wherein:

a) first and second resilient means disposed between said body and said generating means and said weight means, respectively; and b) a rigid member operably secured between said generating means and said weight means.

13. A vehicle as in claim 1, wherein:

a) said generating means includes first and second motors having a common shaft; and b) an eccentric flywheel operably connected to said shaft.

14. A vehicle as in claim 1, and further comprising:

a) means for steering said vehicle.

15. A vehicle as in claim 14, wherein:

a) the vehicle has a center of gravity; and b) said steering means includes means for shifting the center of gravity.

16. A vehicle as in claim 14, wherein:

a) said steering means includes means for providing a drag force on one of the sides of said body.

17. A toy vehicle, comprising:

a) a rigid body having a bottom surface engaging the ground and having front and rear ends;

b) said bottom surface is convex as viewed along a direction substantially transverse to a longitudinal axis of the vehicle and establishing an essentially localized contact area between said body and the ground to thereby permit said body to rotate about said contact area;

c) an eccentric flywheel;

d) means operably secured to said body and disposed adjacent said front end for driving said flywheel;

e) weight means mounted on said body and adjacent said other end; and f) at least a resilient means disposed between said body and one of said drive means and said weight means;

g) whereby the vibratory motions generated by said generating means interact with said weight means and said at least resilient means and said body to periodically rotate and propel the vehicle forward.

18. A toy vehicle as in claim 17, wherein:

a) said driving means includes a battery operated motor; and b) said weight means comprises battery for said motor.

19. A toy vehicle as in claim 17, wherein:

a) first resilient means disposed between said motor and said body;

b) second resilient means disposed between said body and said battery; and c) a rigid member connected to said motor and said battery.

20. A toy vehicle as in claim 17, wherein:

a) said motor is rigidly secured to said body; and b) said weight means is rigidly secured to said body.

21. A vehicle comprising:

a) a rigid longitudinal body having a bottom surface engaging the ground and having front and rear ends;

b) said bottom surface is convex as viewed along a direction substantially transverse to a longitudinal axis of the vehicle and establishing an essentially localized contact area between said body and the ground to thereby permit said body to rotate about said contact area;

c) means mounted adjacent one of said front and rear ends and connected to said body for generating vibratory motions having horizontal and vertical force components, thereby vibrating said body and causing said body to rotate about said contact area;

d) weight means mounted on said body and adjacent the other end of said body;

e) at least a resilient means disposed between said body and one of said generating means and said weight means;

f) whereby the vibratory motions generated by said generating means interact with said weight means and said at least resilient means and said body to periodically rotate and propel the vehicle forward.

22. A vehicle, comprising:

a) a rigid longitudinal body having a bottom surface engaging the ground and having front and rear ends;

b) said bottom surface is convex as viewed along a direction substantially transverse to a longitudinal axis of the vehicle and establishing an essentially localized contact area between said body and the ground to thereby permit said body to rotate about said contact area;

c) means mounted adjacent one of said front and rear ends and connected to said body for generating vibratory motions having horizontal and vertical force components, thereby vibrating said body and causing said body to rotate about said contact area;

d) weight means mounted on said body and adjacent the other end of said body for counter balancing the weight of said generating means about said contact area;

e) at least a resilient means disposed between said body and one of said generating means and said weight means;

f) whereby the vibratory motions generated by said generating means interact with said weight means and said at least resilient means and said body to periodically rotate and propel said vehicle forward.

* * * * *